US007037128B2

(12) United States Patent
Yaworski et al.

(10) Patent No.: US 7,037,128 B2
(45) Date of Patent: May 2, 2006

(54) ELECTRICAL CONNECTORS AND METHODS FOR USING THE SAME

(75) Inventors: Harry George Yaworski, Apex, NC (US); Kenton Archibald Blue, Fuquay-Varina, NC (US); Rudolf Robert Bukovnik, Chapel Hill, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/722,351

(22) Filed: Nov. 25, 2003

(65) Prior Publication Data

US 2004/0157488 A1 Aug. 12, 2004

Related U.S. Application Data

(63) Continuation-in-part of application No. 10/324,817, filed on Dec. 20, 2002, now Pat. No. 6,854,996.

(51) Int. Cl.
*H01R 13/52* (2006.01)

(52) U.S. Cl. ..... 439/276; 439/936; 439/475; 439/212; 174/71 B; 174/88 B; 174/99 B; 174/74 R; 174/77 R

(58) Field of Classification Search ..... 439/519, 439/521, 276, 212, 936, 465, 701, 475; 174/74 R, 174/75 D, 77 R, 71 B, 55 B, 99 B, 88 B
See application file for complete search history.

(56) References Cited

U.S. PATENT DOCUMENTS

| | | | |
|---|---|---|---|
| 2,311,758 | A | 2/1943 | Johansson |
| 3,020,260 | A | 2/1962 | Nelson |
| 4,369,284 | A | 1/1983 | Chen |
| 4,425,017 | A | 1/1984 | Chan |
| 4,595,635 | A | 6/1986 | Dubrow et al. |
| 4,600,261 | A | 7/1986 | Debbaut |
| 4,634,207 | A | 1/1987 | Debbaut |
| 4,680,233 | A | 7/1987 | Camin et al. |
| 4,701,574 | A | 10/1987 | Shimirak et al. |
| 4,716,183 | A | 12/1987 | Gamarra et al. |
| 4,721,832 | A | 1/1988 | Toy |
| 4,777,063 | A | 10/1988 | Dubrow et al. |
| 4,852,646 | A | 8/1989 | Dittmer et al. |
| 4,880,676 | A | 11/1989 | Puigcerver et al. |
| 4,888,070 | A | 12/1989 | Clark et al. |
| 4,942,270 | A | 7/1990 | Gamarra |
| 4,963,700 | A | 10/1990 | Olsen et al. |

(Continued)

FOREIGN PATENT DOCUMENTS

DE 34 28 258 A1 2/1986

(Continued)

OTHER PUBLICATIONS

Homac Mfg. Company, Fact Sheet, "*Flood-Seal*"® *Rubberized Aluminum Bar.*

(Continued)

*Primary Examiner*—Briggitte R. Hammond
(74) *Attorney, Agent, or Firm*—Myers Bigel Sibley & Sajovec, P.A.

(57) ABSTRACT

An electrical connector for use with a conductor includes a housing defining a port. The port includes an entrance opening, an exit opening, and a conductor passage extending between and communicating with the entrance and exit openings. The conductor passage is adapted to receive the conductor therethrough. Sealant is disposed in the conductor passage. The sealant is adapted for insertion of the conductor therethrough such that the sealant provides a seal about the inserted conductor. A penetrable closure wall extends across the conductor passage.

49 Claims, 13 Drawing Sheets

U.S. PATENT DOCUMENTS

| | | | |
|---|---|---|---|
| 5,023,402 | A | 6/1991 | King, Jr. et al. |
| 5,079,300 | A | 1/1992 | Dubrow et al. |
| 5,099,088 | A | 3/1992 | Usami et al. |
| 5,140,476 | A | 8/1992 | Kim |
| 5,177,143 | A | 1/1993 | Chang et al. |
| 5,357,057 | A | 10/1994 | Debbaut |
| 5,529,508 | A | 6/1996 | Chiotis et al. |
| 5,561,269 | A | 10/1996 | Robertson et al. |
| 5,588,856 | A | 12/1996 | Collins et al. |
| 5,824,954 | A | 10/1998 | Biche et al. |
| 5,828,005 | A | 10/1998 | Huynh-Ba et al. |
| 5,848,913 | A | 12/1998 | Ashcraft |
| 5,962,811 | A | 10/1999 | Rodrigues et al. |
| 6,025,559 | A | 2/2000 | Simmons |
| 2002/0102874 | A1 | 8/2002 | Hobson et al. |

FOREIGN PATENT DOCUMENTS

| | | | |
|---|---|---|---|
| DE | 90 04 669 | U1 | 6/1990 |
| EP | 0 108 518 | B1 | 5/1984 |
| EP | 0 203 737 | A2 | 12/1986 |
| EP | 0 328 386 | A2 | 8/1989 |
| WO | WO 88/00603 | A2 | 1/1988 |
| WO | WO 90/05401 | A1 | 5/1990 |
| WO | WO 95/15600 | A1 | 6/1995 |
| WO | WO 95/24756 | A1 | 9/1995 |
| WO | WO 96/23007 | A1 | 8/1996 |
| WO | WO 97/42693 | A1 | 11/1997 |

OTHER PUBLICATIONS

Connector Mfg. Company. Fact Sheet, *Submersible Secondary Connectors*, Jun. 2001, p. B-1.

Fitzgerald et al., *Electrical Connection Protector Kit and Method for Using the Same*, U.S. Appl. No. 09/660,062, filed Sep. 12, 2000.

Fitzgerald et al., *Electrical Connection Protector Kit and Method for Using the Same*, U.S. Appl. No. 09/539,541, filed Mar. 31, 2000.

Copy of International Search Report for PCT/US03/38594 (mailing date Apr. 27, 2004).

ELECTRICAL CONNECTORS AND METHODS FOR USING THE SAME

RELATED APPLICATION(S)

The present application is a continuation-in-part application (CIP) of and claims priority from U.S. patent application Ser. No. 10/324,817, filed Dec. 20, 2002 now U.S. Pat. No. 6,854,996, the disclosure of which is hereby incorporated herein by reference in its entirety.

FIELD OF THE INVENTION

The present invention relates to electrical connectors and methods for using the same and, more particularly, to environmentally protected electrical connectors and methods for forming environmentally protected connections.

BACKGROUND OF THE INVENTION

Multi-tap or busbar connectors are commonly used to distribute electrical power, for example, to multiple residential or commercial structures from a common power supply feed. Busbar connectors typically include a conductor member formed of copper or aluminum housed in a polymeric cover. The conductor member includes a plurality of cable bores. The cover includes a plurality of ports, each adapted to receive a respective cable and to direct the cable into a respective one of the cable bores. A set screw is associated with each cable bore for securing the cables in the respective bores and, thereby, in electrical contact with the conductor member.

The busbar assemblies as described above can be used to electrically connect two or more cables. For example, a feed cable may be secured to the busbar connector through one of the ports and one or more branch or tap circuit cables may be connected to the busbar connector through the other ports, to distribute power from the feed cable. Busbar connectors of this type provide significant convenience in that cables can be added and removed from the connection as needed.

Power distribution connections as discussed above are typically housed in an above-ground cabinet or a below-grade box. The several cables are usually fed up through the ground and the connection (including the busbar connector) may remain unattached to the cabinet or box (i.e., floating within the cabinet). The connections may be subjected to moisture, and may even become submerged in water. If the conductor member and the conductors are left exposed, water and environmental contaminants may cause corrosion thereon. Moreover, the conductor member is often formed of aluminum, so that water may cause oxidation of the conductor member. Such oxidation may be significantly accelerated by the relatively high voltages (typically 120 volts to 1000 volts) employed. In order to reduce or eliminate exposure of the conductor member and the conductor portions of the cables to water, some known busbar designs include elastomeric boots or caps. These caps or boots may be difficult or inconvenient to install properly, particularly in the field, and may not provide reliable seals.

SUMMARY OF THE INVENTION

According to embodiments of the present invention, a busbar assembly for electrically connecting a plurality of conductors includes a housing defining an interior cavity and first and second ports. The first and second ports each include a conductor passage and communicate with the interior cavity. The conductor passages are each adapted to receive a conductor therethrough. An electrically conductive busbar conductor member is disposed in the interior cavity. At least one holding mechanism is provided to selectively secure each of the conductors to the busbar conductor member for electrical contact therewith. Sealant is disposed in the conductor passages of each of the first and second ports. The sealant is adapted for insertion of the conductors therethrough such that the sealant provides a seal about the inserted conductors. The sealant may be a gel.

According to method embodiments of the present invention, a method is provided for forming a connection between an electrical connection between a busbar assembly and first and second conductors, the busbar assembly including a housing, an electrically conductive busbar conductor member, at least one holding mechanism and a sealant, the housing defining an interior cavity and first and second ports each including a conductor passage and communicating with the interior cavity, the busbar member being disposed in the interior cavity, the sealant being disposed in the conductor passages of each of the first and second ports. The method includes inserting each of the first and second conductors through a respective one of the conductor passages and the sealant disposed therein and into the interior cavity such that the sealant provides a seal about the first and second conductors. The method further includes selectively securing each of the conductors to the busbar conductor member for electrical contact therewith using the at least one holding mechanism.

According to embodiments of the present invention, an electrical connector for use with a conductor includes a housing defining a port. The port includes an entrance opening, an exit opening, and a conductor passage extending between and communicating with the entrance and exit openings. The conductor passage is adapted to receive the conductor therethrough. A sleeve member is disposed in the conductor passage and defines a sleeve passage. Sealant is disposed in the sleeve passage. The sealant is adapted for insertion of the conductor therethrough such that the sealant provides a seal about the inserted conductor. The sealant may be a gel.

According to further embodiments of the present invention, an insert assembly for providing a seal to an electrical connector, the electrical connector including a housing defining a port, the port including an entrance opening, an exit opening, and a conductor passage extending between and communicating with the entrance and exit openings, the conductor passage being adapted to receive a conductor therethrough, includes a sleeve member adapted to be inserted into the conductor passage. The sleeve member defines a sleeve passage. Sealant is disposed in the sleeve passage. The sealant is adapted for insertion of the conductor therethrough such that the sealant provides a seal about the inserted conductor. The sealant may be a gel.

According to method embodiments of the present invention, a method is provided for providing a seal to an electrical connector, the electrical connector including a housing defining a port, the port including an entrance opening, an exit opening, and a conductor passage extending between and communicating with the entrance and exit openings, the conductor passage being adapted to receive a conductor therethrough. The method includes inserting an insert member into the conductor passage. The insert member includes a sleeve member defining a sleeve passage. The sleeve member further includes sealant disposed in the sleeve passage. The sealant is adapted for insertion of the conductor therethrough such that the sealant provides a seal about the inserted conductor.

According to further embodiments of the present invention, an electrical connector for use with a conductor is provided. The electrical connector defines an access opening and an access passage communicating with the access opening and includes a holding mechanism operable to secure the conductor to the electrical connector. The holding mechanism is accessible through the access opening and the access passage. Access sealant is disposed in the access passage and is adapted to seal the access passage. The access sealant may be a gel.

According to further embodiments, an electrical connector for use with a conductor includes a housing defining a port. The port includes an entrance opening, an exit opening, and a conductor passage extending between and communicating with the entrance and exit openings. The conductor passage is adapted to receive the conductor therethrough. Sealant is disposed in the conductor passage. The sealant is adapted for insertion of the conductor therethrough such that the sealant provides a seal about the inserted conductor. A penetrable closure wall extends across the conductor passage.

According to further method embodiments of the present invention, a method is provided for forming a connection between an electrical connector and a conductor, the electrical connector including a housing defining a port, the port including an entrance opening, an exit opening and a conductor passage extending between and communicating with the entrance and exit openings, the electrical connector further including sealant disposed in the conductor passage and a penetrable closure wall extending across the conductor passage. The method includes inserting the conductor through the conductor passage and the sealant disposed therein such that the sealant provides a seal about the conductor. The closure wall is penetrated with the conductor.

Objects of the present invention will be appreciated by those of ordinary skill in the art from a reading of the figures and the detailed description of the preferred embodiments which follow, such description being merely illustrative of the present invention.

DETAILED DESCRIPTION OF THE EMBODIMENTS OF THE INVENTION

Figure 1:
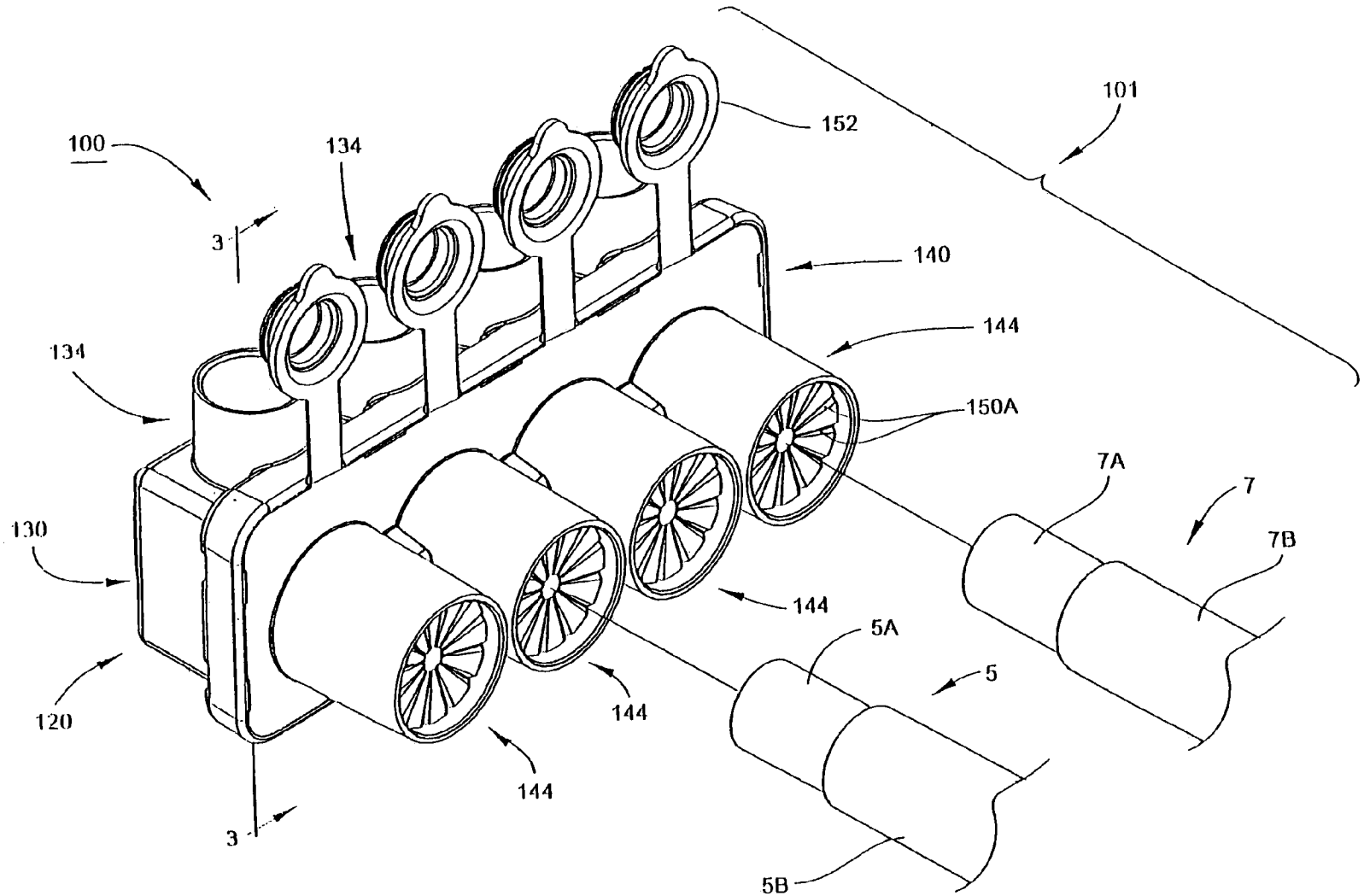
FIG. 1 is a perspective view of an electrical connection assembly including a busbar assembly according to embodiments of the present invention and a pair of cables, wherein the cables are exploded from the busbar assembly.

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements throughout.

Figure 2:
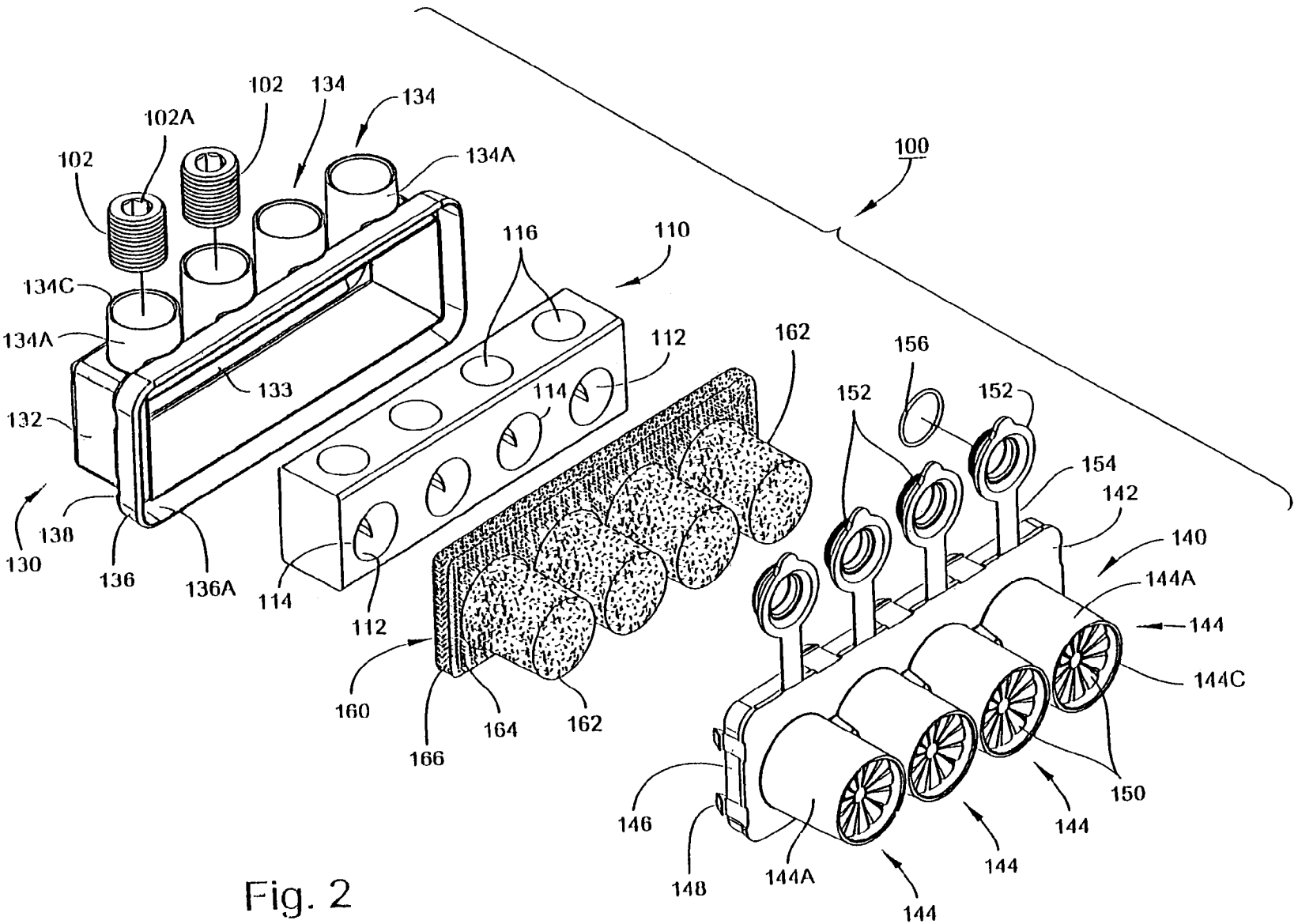
FIG. 2 is an exploded, perspective view of the busbar assembly of FIG. 1.
Figure 3:
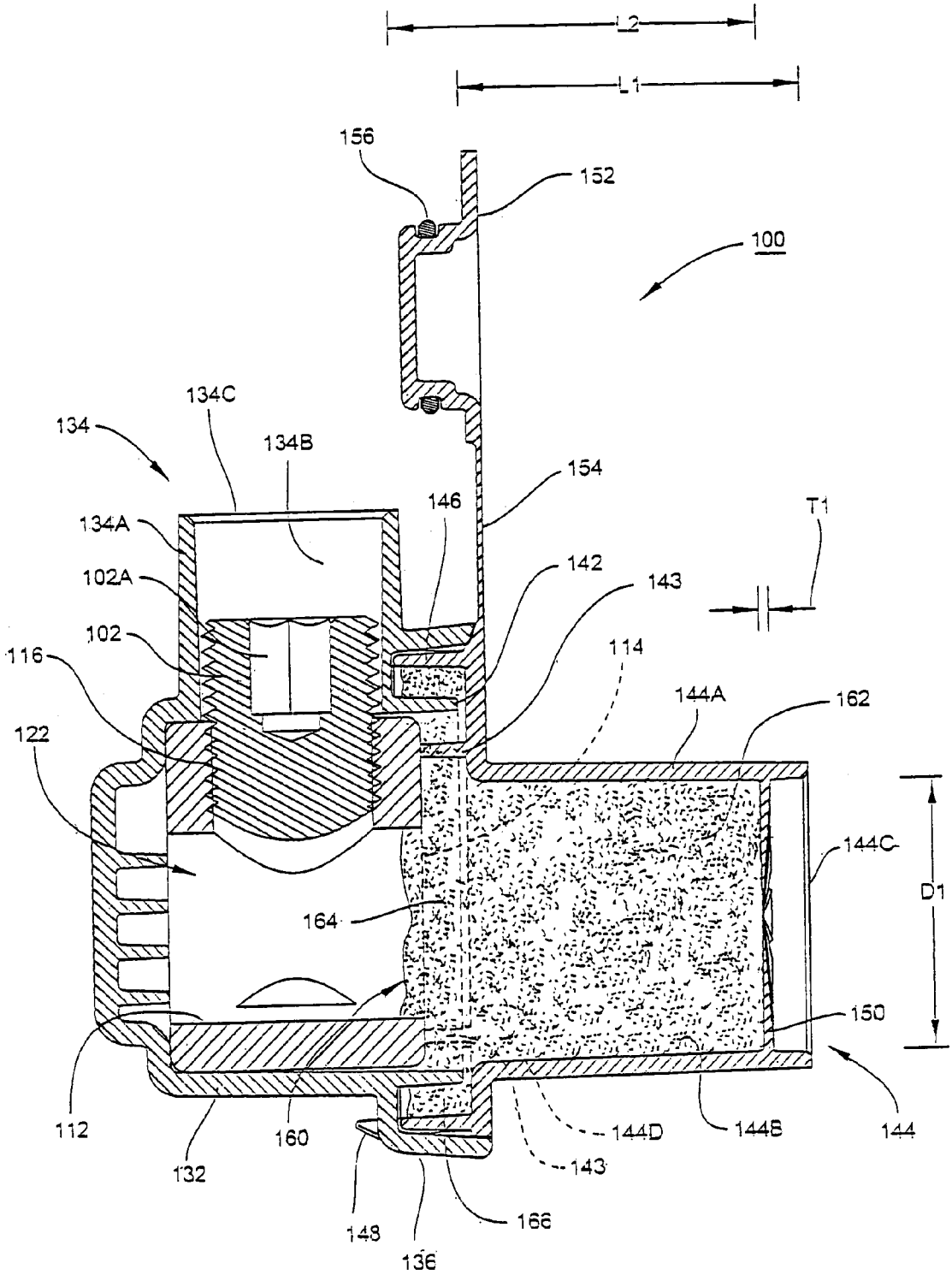
FIG. 3 is a cross-sectional view of the busbar assembly of FIG. 1 taken along the line 3—3 of FIG. 1.
Figure 4:
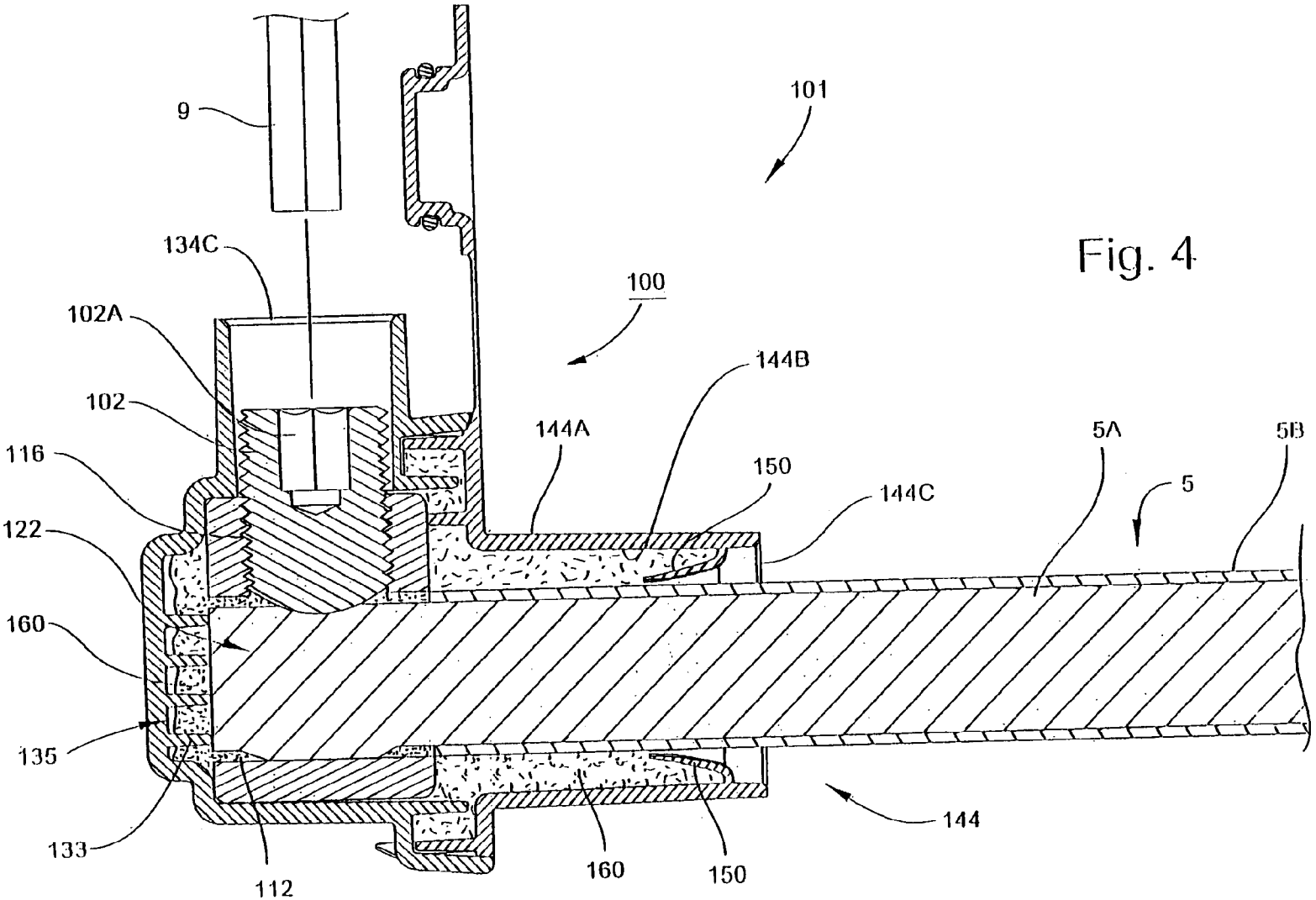
FIG. 4 is a cross-sectional view of the busbar assembly of FIG. 1 taken along the same line as the view of FIG. 3, and wherein a cable is installed in the busbar assembly.
Figure 5:
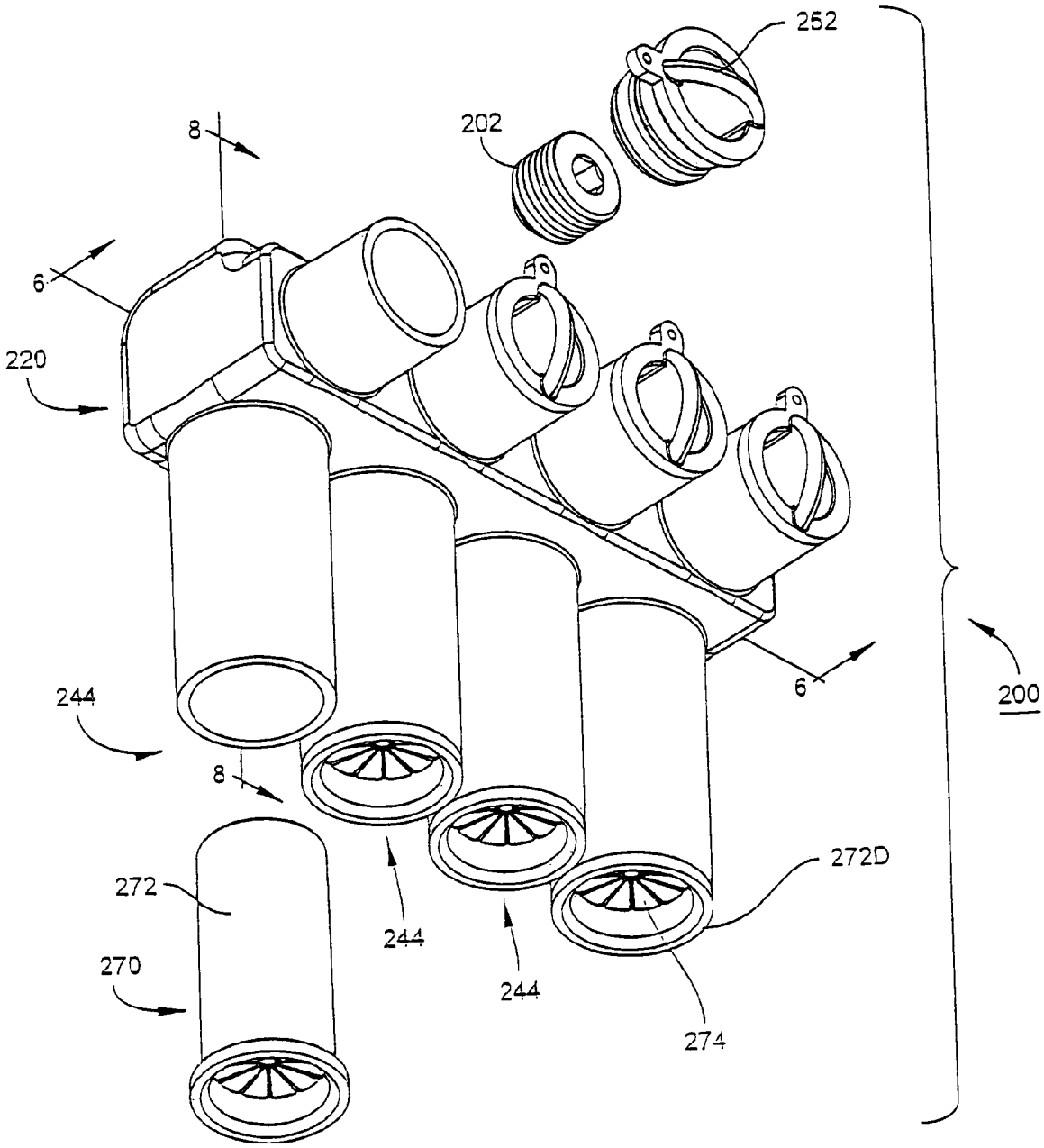
FIG. 5 is an exploded, perspective view of a busbar assembly according to further embodiments of the present invention.
Figure 7:
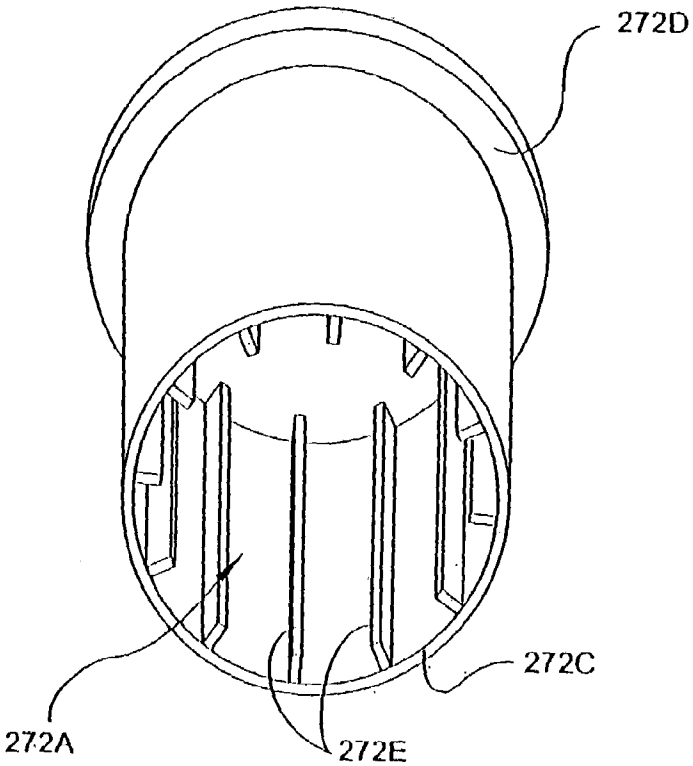
FIG. 7 is a rear, perspective view of a sleeve member forming a part of the busbar assembly of FIG. 5.
Figure 6:
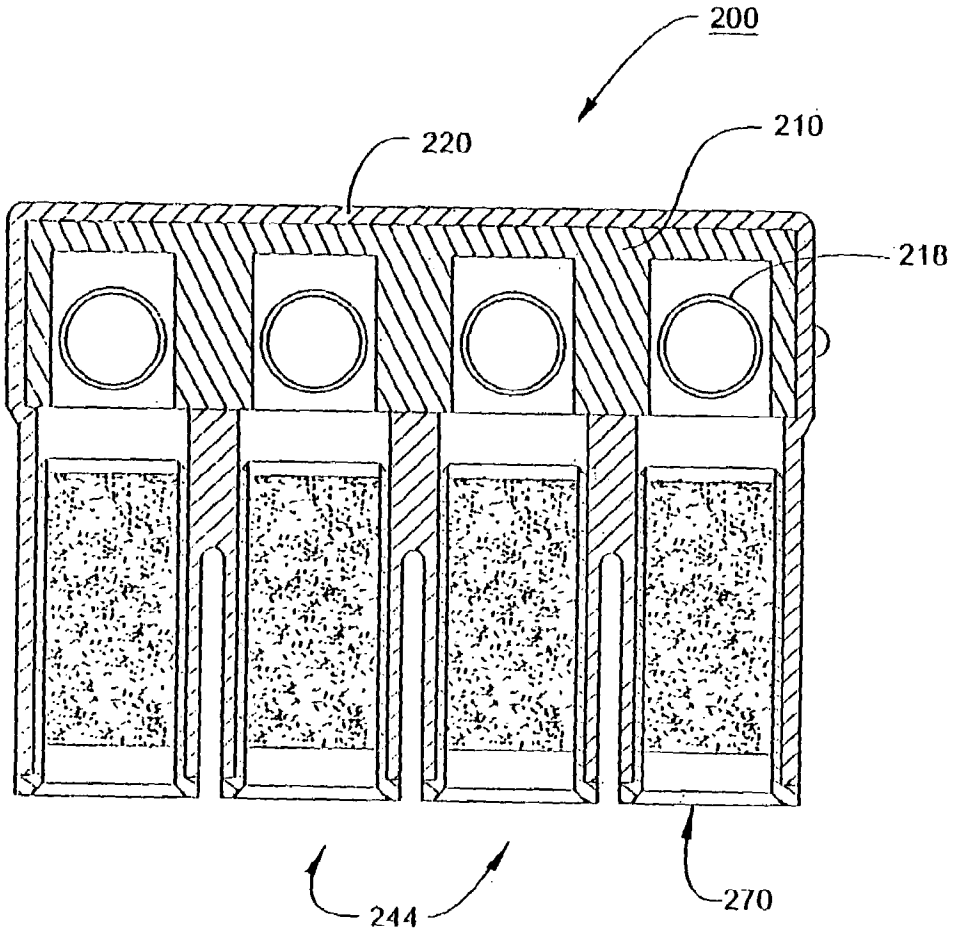
FIG. 6 is a cross-sectional view of the busbar assembly of FIG. 5 taken along the line 6—6 of FIG. 5.
Figure 8:
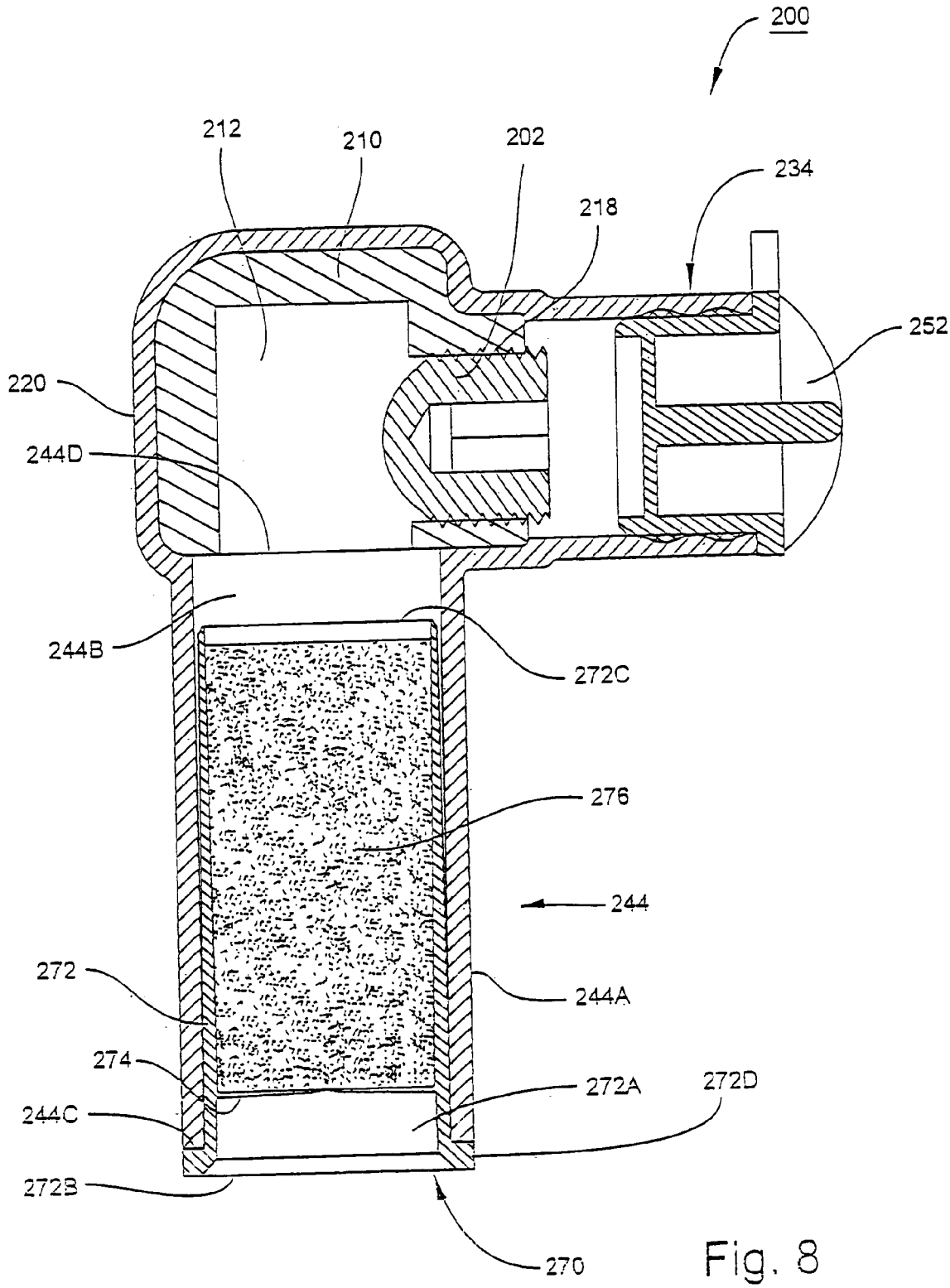
FIG. 8 is a cross-sectional view of the busbar assembly of FIG. 5 taken along the line 8—8 of FIG. 5.

With reference to FIGS. 1–4, a connector or busbar assembly 100 according to embodiments of the present invention is shown therein. The busbar assembly 100 may be used to electrically connect a plurality of electrical connectors, such as conductors 5A and 7A of cables 5 and 7 (which further include electrically insulative sheaths or covers 5B, 7B), as shown in FIGS. 1 and 4. The busbar assembly 100 may provide an environmentally protected and, preferably, watertight connector and connection. For example, the busbar assembly 100 may be used to electrically connect the conductors of a power feed cable and one or more branch or tap cables, while preventing the conductive portions of the cables and the busbar assembly 100 from being exposed to surrounding moisture or the like.

Turning to the busbar assembly 100 in more detail, the busbar assembly 100 includes a busbar conductor member 110, a cover assembly 120, a plurality of set screws 102 (only two shown in FIG. 2), and a mass of sealant 160. The cover assembly 120 includes a rear cover member 130 and a front cover member 140. The cover assembly 120 defines an interior cavity 122 within which the conductor member 110 is disposed. The interior cavity 122 is environmentally protected.

The conductor member 110 includes four cable or conductor bores 112, each having a front opening 114. The conductor bores 112 are sized and shaped to receive the conductors 5A, 7A. Four threaded bores 116 extend orthogonally to and intersect respective ones of the conductor bores 112. The conductor member 110 may be formed of any suitable electrically conductive material. In some embodiments, the conductor member 110 is formed of copper or aluminum. In certain preferred embodiments, the conductor member 110 is formed of aluminum. The conductor member 110 may be formed by molding, stamping, extrusion and/or machining, or by any other suitable process(es).

The rear cover member 130 includes a body portion 132. A plurality of transversely extending ribs 133 project into the interior cavity 122 from the body portion 132. Four access ports 134 are provided on the body portion 132. Each access port 134 includes an access tube 134A defining an access passage 134B. The access passage 134B communicates with an access opening 134C and the interior cavity 122. A perimeter flange 136 extends about the body portion 132 and defines a perimeter channel 136A. A plurality of latch slots 138 are formed in the flange 136.

The front cover member 140 includes a body portion 142. A pair of transversely extending spacer ribs 143 (FIG. 3) extend transversely to the body portion 142. Four conductor or cable ports 144 are provided on the body portion 142. Each port 144 includes a cable tube 144A defining a cable passage 144B. The cable passage 144B communicates with an entrance opening 144C and an exit opening 144D. A frangible closure wall 150 extends across the passage 144B between the openings 144C and 144D.

A perimeter flange 146 surrounds and projects rearwardly from the body portion 142. A plurality of barbed latch projections 148 extend rearwardly from the flange 146.

Four plugs or caps 152 are joined to the body portion 142 by a flexible connecting portion 154. The caps 152 are sized and shaped to fit in respective ones of the access passageways 134B and access openings 134C. An O-ring (e.g., formed of an elastomer or the like) is provided on each cap 152 to provide a seal between the caps 152 and the access ports 134.

Preferably, the front cover member 140 is integrally formed and the rear cover member 130 is integrally formed. The cover members 130, 140 may be formed of any suitable electrically insulative material. Preferably, the cover members 130, 140 are formed of a molded polymeric material. More preferably, the cover members 130, 140 are formed of polypropylene, polyethylene or a thermoplastic elastomer. The cover members 130, 140 may be formed of a flame retardant material, and may include a suitable additive to make the cover members flame retardant.

Each of four set screws 102 (only two shown in FIG. 2) is threadedly installed in a respective one of the threaded bores 116. Each of the screws 102 includes a socket 102A which may be adapted to receive a driver 9 (FIG. 4), for example.

As best seen in FIGS. 2 and 3, the sealant 160 is disposed in the cover assembly 120. More particularly, a body sealant portion 164 of the sealant 160 is disposed in a front portion of the interior cavity 122. A plurality of port sealant portions 162 are disposed in respective ones of the ports 144. In some embodiments and as illustrated, each port sealant portion 162 extends from the inner side of the closure wall 150 to the exit opening 144D of the associated port 144 and is contiguous with the body sealant portion 164. The sealant portion 164 includes a perimeter portion 166 that is disposed in the channel 136A to form a surrounding seal between the cover members 130, 140.

According to some embodiments of the invention, the sealant 160 is a gel. The term "gel" has been used in the prior art to cover a vast array of materials from greases to thixotropic compositions to fluid-extended polymeric systems. As used herein, "gel" refers to the category of materials which are solids extended by a fluid extender. The gel may be a substantially dilute system that exhibits no steady state flow. As discussed in Ferry, "Viscoelastic Properties of Polymers," 3$^{rd}$ ed. P. 529 (J. Wiley & Sons, New York 1980), a polymer gel may be a cross-linked solution whether linked by chemical bonds or crystallites or some other kind of junction. The absence of the steady state flow may be considered to be the key definition of the solid-like properties while the substantial dilution may be necessary to give the relatively low modulus of gels. The solid nature may be achieved by a continuous network structure formed in the material generally through crosslinking the polymer chains through some kind of junction or the creation of domains of associated substituents of various branch chains of the polymer. The crosslinking can be either physical or chemical as long as the crosslink sites may be sustained at the use conditions of the gel.

Preferred gels for use in this invention are silicone (organopolysiloxane) gels, such as the fluid-extended systems taught in U.S. Pat. No. 4,634,207 to Debbaut (hereinafter "Debbaut '207"); U.S. Pat. No. 4,680,233 to Camin et al.; U.S. Pat. No. 4,777,063 to Dubrow et al.; and U.S. Pat No. 5,079,300 to Dubrow et al. (hereinafter "Dubrow '300"), the disclosures of which are hereby incorporated herein by reference. These fluid-extended silicone gels may be created with nonreactive fluid extenders as in the previously recited patents or with an excess of a reactive liquid, e.g., a vinyl-rich silicone fluid, such that it acts like an extender, as exemplified by the Sylgard® 527 product commercially available from Dow-Corning of Midland, Mich. or as disclosed in U.S. Pat. No. 3,020,260 to Nelson. Because curing is involved in the preparation of these gels, they are sometimes referred to as thermosetting gels. An especially preferred gel is a silicone gel produced from a mixture of divinyl terminated polydimethylsiloxane, tetrakis(dimethylsiloxy)silane, a platinum divinyltetramethyldisiloxane complex, commercially available from United Chemical Technologies, Inc. of Bristol, Pa., polydimethylsiloxane, and 1,3,5,7-tetravinyltetra-methylcyclotetrasiloxane (reaction inhibitor for providing adequate pot life).

Other types of gels may be used, for example, polyurethane gels as taught in the aforementioned Debbaut '261 and U.S. Pat. No. 5,140,476 Debbaut (hereinafter "Debbaut '476") and gels based on styrene-ethylene butylenestyrene (SEBS) or styrene-ethylene propylene-styrene (SEPSS) extended with an extender oil of naphthenic or nonaromatic or low aramatic content hydrocarbon oil, as described in U.S. Pat. No.4,369,284 to Chen; U.S. Pat. No.4,716,183 to Gamarra et al.; and U.S. Pat. No. 4,942,270 to Gamarra. The SEBS and SEPS gels comprise glassy styrenic microphases interconnected by a fluid-extended elastomeric phase. The microphase-separated styrenic domains serve as the junction points in the systems. The SEBS and SEPS gels are examples of thermoplastic systems.

Another class of gels which may be considered are EPDM rubber based gels, as described in U.S. Pat. No. 5,177,143 to Chang et al.

Yet another class of gels which may be suitable are based on anhydride-containing polymers, as disclosed in WO 96/23007. These gels reportedly have good thermal resistance.

The gel may include a variety of additives, including stabilizers and antioxidants such as hindered phenols (e.g., Irganox™ 1076, commercially available from Ciba-Geigy Corp. of Tarrytown, N.Y.), phosphites (e.g., Irgafos™ 168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (i.e., Cyasorb UV-531, commercially available from American Cyanamid Co. of Wayne, N.J.), and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackifiers and the like described in "Additives for Plastics, Edition 1" published by D.A.T.A., Inc. and The International Plastics Selector, Inc., San Diego, Calif.

The hardness, stress relaxation, and tack may be measured using a Texture Technologies Texture Analyzer TA-XT2 commercially available from Texture Technologies Corp. of Scarsdale, New York, or like machines, having a five kilogram load cell to measure force, a 5 gram trigger, and ¼ inch (6.35 mm) stainless steel ball probe as described in Dubrow '300, the disclosure of which is incorporated herein by reference in its entirety. For example, for measuring the hardness of a gel a 60 mL glass vial with about 20 grams of gel, or alternately a stack of nine 2 inch×2 inch×⅛" thick slabs of gel, is placed in the Texture Technologies Texture Analyzer and the probe is forced into the gel at the speed of 0.2 mm per sec to a penetration distance of 4.0 mm. The hardness of the gel is the force in grams, as recorded by a computer, required to force the probe at that speed to penetrate or deform the surface of the gel specified for 4.0 mm. Higher numbers signify harder gels. The data from the Texture Analyzer TA-XT2 may be analyzed on an IBM PC or like computer, running Microsystems Ltd, XT.RA Dimension Version 2.3 software.

The tack and stress relaxation are read from the stress curve generated when the XT.RA Dimension version 2.3 software automatically traces the force versus time curve experienced by the load cell when the penetration speed is 2.0 mm/second and the probe is forced into the gel a penetration distance of about 4.0 mm. The probe is held at 4.0 mm penetration for 1 minute and withdrawn at a speed of 2.00 mm/second. The stress relaxation is the ratio of the initial force ($F_i$) resisting the probe at the pre-set penetration depth minus the force resisting the probe ($F_f$) after 1 min divided by the initial force $F_i$, expressed as a percentage. That is, percent stress relaxation is equal to $$\frac{(F_i - F_f)}{F_i} \times 100\%$$

where $F_i$ and $F_f$ are in grams. In other words the stress relaxation is the ratio of the initial force minus the force after 1 minute over the initial force. It may be considered to be a measure of the ability of the gel to relax any induced compression placed on the gel. The tack may be considered to be the amount of force in grams resistance on the probe as it is pulled out of the gel when the probe is withdrawn at a speed of 2.0 mm/second from the preset penetration depth.

An alternative way to characterize the gels is by cone penetration parameters according to ASTM D-217 as proposed in Debbaut '261; Debbaut '207; Debbaut '746; and U.S. Pat. No.5,357,057 to Debbaut et al., each of which is incorporated herein by reference in its entirety. Cone penetration ("CP") values may range from about 70 ($10^{-1}$ mm) to about 400 ($10^{-1}$ mm). Harder gels may generally have CP values from about 70 ($10^{-1}$ mm) to about 120 ($10^{-1}$ mm). Softer gels may generally have CP values from about 200 ($10^{-1}$ mm) to about 400 ($10^{-1}$ mm), with particularly preferred range of from about 250 ($10^{-1}$ mm) to about 375 ($10^{-1}$ mm). For a particular materials system, a relationship between CP and Voland gram hardness can be developed as proposed in U.S. Pat. No. 4,852,646 to Dittmer et al.

Preferably, the gel has a Voland hardness, as measured by a texture analyzer, of between about 5 and 100 grams force, more preferably of between about 5 and 30 grams force, and, most preferably, of between about 10 and 20 grams force. Preferably, the gel has an elongation, as measured by ASTM D-638, of at least 55%, more preferably of at least 100%, and most preferably of at least 1,000%. Preferably, the gel has a stress relaxation of less than 80%, more preferably of less than 50%, and most preferably of less than 35%. The gel has a tack preferably greater than about 1 gram, more preferably greater than about 6 grams, and most preferably between about 10 and 50 grams. Suitable gel materials include POWERGEL sealant gel available from Tyco Electronics Energy Division of Fuquay-Varina, NC under the RAYCHEM brand.

Alternatively, the sealant 160 may be silicone grease or a hydrocarbon-based grease.

Referring to FIG. 4, the busbar assembly 100 may be used in the following manner to form an electrical connection assembly 101 as shown therein. The connection assembly 101 includes the busbar assembly 100 and the cable 5, and may include additional cables secured to the busbar assembly 100 in the manner described immediately hereinafter.

With the set screw 102 in a raised position as shown in FIG. 3, the cable 5 is inserted into the selected port 144. More particularly, the terminal end of the cable 5 (which has an exposed portion of the conductor 5A) is inserted through the entrance opening 144C, the passage 144A, and the exit opening 144D, and into the conductor bore 112. In doing so, the closure wall 150 is ruptured by the cable end and the sealant 160 is displaced as shown in FIG. 4. Preferably and as shown, the busbar assembly 100 is configured such that the interior cavity 122 includes a volume of a compressible gas (e.g., air) to allow insertion of the cable 5 without a proportionate displacement of the sealant 160 out of the interior cavity 122.

The set screw 102 is then rotatively driven (for example, using the driver 9) into the threaded bore 116 to force the exposed portion of the conductor 5A against the opposing wall of the bore 112. The cap 152 is then replaced over the access opening 134C.

In this manner, the cable 5 is mechanically secured to or captured within the busbar assembly 100 and electrically connected to the conductor member 110. One or more additional cables may be inserted through the other ports 144 and secured using the other set screws 102. In this manner, such other cables are thereby electrically connected to the cable 5 and to one another through the conductor member 110.

When, as preferred, the sealant 160 is a gel, the cable 5 and the tube 144A apply a compressive force to the sealant 160 as the cable 5 is inserted into the busbar assembly 100. The gel is thereby elongated and is generally deformed and substantially conforms to the outer surface of the cable 5 and to the inner surface of the tube 144A. The elongated gel may extend into and through the conductor bore 112. Moreover, the elongated gel may extend beyond the conductor member 110 into an expansion chamber 135 created by the ribs 133. Some shearing of the gel may occur as well. Preferably, at least some of the gel deformation is elastic. The restoring force in the gel resulting from this elastic deformation causes the gel to operate as a spring exerting an outward force between the tube 144 and the cable 5.

The ruptured closure wall 150 may serve to prevent or limit displacement of the gel sealant 160 out of the port 144 toward the entrance opening 144C, thereby promoting displacement of the gel into the interior cavity 122. Preferably, the busbar assembly is adapted such that, when the cable 5 is installed, the gel has an elongation at the interface between the gel 160 and the inner surface of the tube 144A of at least 20%.

Each of the closure walls 150 serves as a dam for the gel or other sealant 160 in use. Additionally, the closure walls 150 serve as mechanical covers (for example, to prevent or reduce the entry of dust and the like). Moreover, the closure walls 150 may serve as dams for the gel or other sealant 160 during manufacture, as described below. It will be appreciated that, in some embodiments of the present invention, the closure walls 150 can be omitted.

The busbar assembly 100 may provide a reliable (and, in at least some embodiments, moisture-tight) seal between the busbar assembly 100 and the cable 5, as well as any additional cables secured in the ports 144. The sealant 160, particularly gel sealant, may accommodate cables of different sizes within a prescribed range. The ports 144 which do not have cables installed therein are likewise sealed by the sealant 160. Upon removal of a cable, the associated port 144 may be resealed by the re-formation of the gel sealant 160.

Various properties of the gel, as described above may ensure that the gel sealant 160 maintains a reliable and long lasting hermetic seal between the tube 144A and the cable 5. The elastic memory of and the retained or restoring force in the elongated, elastically deformed gel generally cause the gel to bear against the mating surfaces of the cable 5 and the interior surface of the tube 144A. Also, the tack of the gel may provide adhesion between the gel and these surfaces. The gel, even though it is cold-applied, is generally able to flow about the cable 5 and the connector 100 to accommodate their irregular geometries.

Preferably, the sealant 160 is a self-healing or self-amalgamating gel. This characteristic, combined with the aforementioned compressive force between the cable 5 and the tube 144A, may allow the sealant 160 to re-form into a continuous body if the gel is sheared by the insertion of the cable 5 into the connector 100. The gel may also re-form if the cable 5 is withdrawn from the gel.

The sealant 160, particularly when formed of a gel as described herein, may provide a reliable moisture barrier for the cable 5 and the conductor member 110, even when the connection 101 is submerged or subjected to extreme temperatures and temperature changes. Preferably, the cover members 130, 140 are made from an abrasion resistant material that resists being punctured by the abrasive forces.

The gel may also serve to reduce or prevent fire. The gel is typically a more efficient thermal conductor than air and, thereby, may conduct more heat from the connection. In this manner, the gel may reduce the tendency for overheating of the connection 101 that might otherwise tend to deteriorate the cable insulation and cause thermal runaway and ensuing electrical arcing at the connection 101. Moreover, the gel may be flame retardant.

The busbar assembly 100 may be formed in the following manner. If the sealant 160 requires curing, such as a curable gel, the sealant may be cured in situ. The front cover member 140 is oriented vertically with the body portion 142 over the ports 144. Liquid, uncured sealant is dispensed into the front cover member 140, such that it fills the cable passages 144B above the closure walls 150 and also fills a portion of the body member 142 (the flange 146 serving as a surrounding side dam). The sealant is then cured in situ.

The cover members 130, 140 are then joined and interlocked by means of the latch slots 138 and the latch projections 148 about the conductor member 110. The set screws 102 are installed in the threaded bores 116 through the access ports 134. The O-rings 156 are installed on the caps 152.

According to some embodiments, the following dimensions may be preferred. Preferably, the length L1 (FIG. 3) of the cable passages 144B is at least 1.0 inch and, more preferably, between about 1.0 and 2.5 inch. Preferably, the length L2 (FIG. 3) of the sealant 160 is at least 0.75 inch and, more preferably, between about 0.75 and 2.25 inch. Preferably, the nominal diameter D1 (FIG. 3) of the cable passages 144B is at least 1.0 inch. More preferably, the diameter D1 is between about 1.0 and 2.0 inches. Preferably, the diameter D1 is between about 15 and 30% greater than the diameter of the largest cable (including insulative cover) the port 144 is intended to accommodate. Preferably, the busbar assembly 100 is adapted to accommodate cables having a full diameter (including insulative cover) of between about 0.125 and 0.875 inch. Preferably, the expansion chamber 135 has a volume of at least 1.0 $in^3$.

Preferably, each closure wall 150 has a maximum thickness T1 (FIG. 3) of no more than 0.25 inch, and more preferably between about 0.005 and 0.125 inch. Preferably, each closure wall 150 has an insertion force (i.e., force required to penetrate the plane of the closure wall 150 with the intended cable) of between about 1 lb. and 40 lbs and, more preferably, of between about 1 lb and 10 lbs. Each closure wall 150 may be molded with lines of reduced thickness or pre-cut or slotted after molding to create tear lines 150A (FIG. 1) that reduce the required assembly force to the desired level. Each closure wall 150 may be constructed as a membrane that substantially entirely seals the conductor passage 144B prior to being ruptured.

Figure 9:
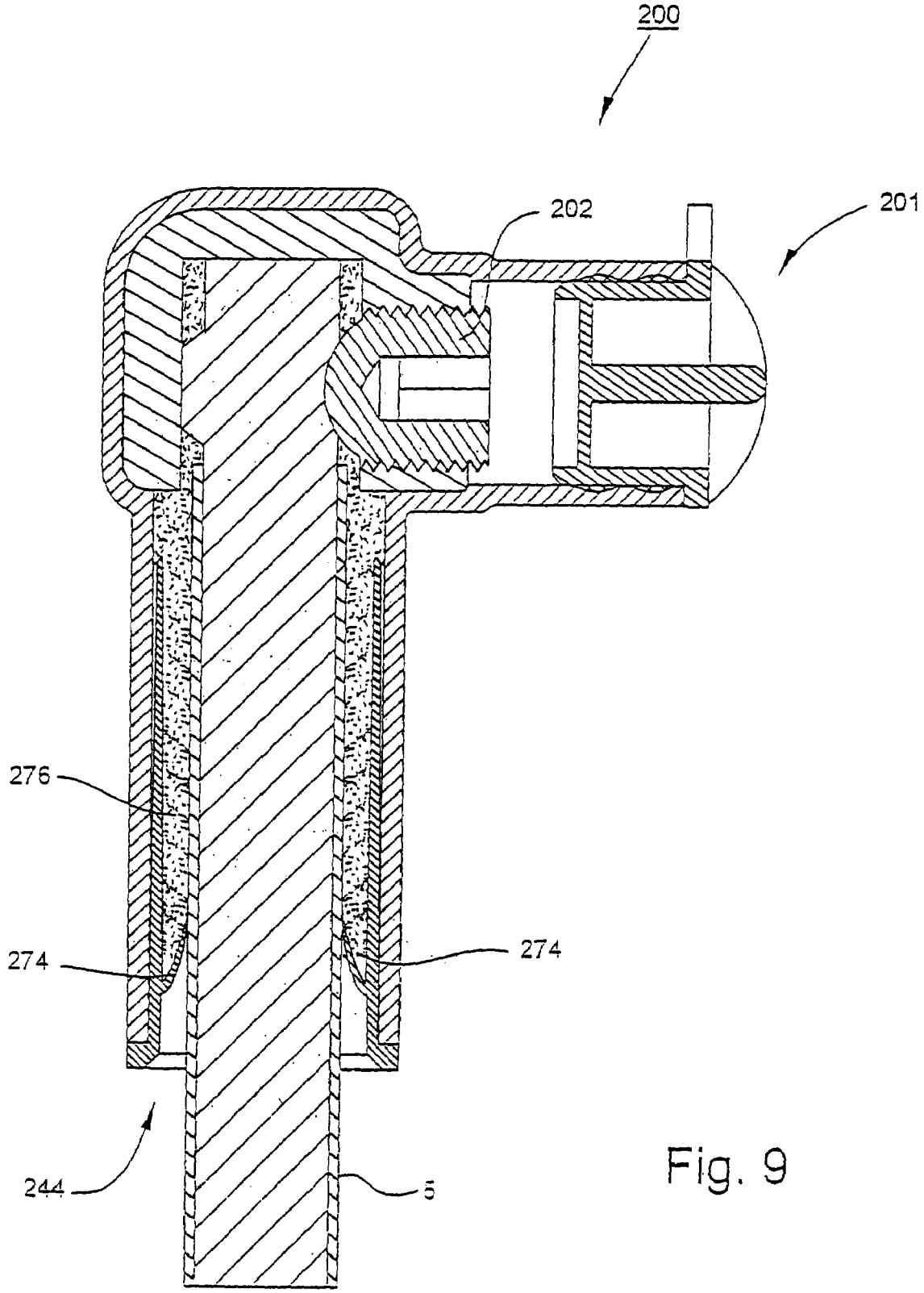
FIG. 9 is a cross-sectional view of the busbar assembly of FIG. 5 taken along the same line as the view of FIG. 8, and wherein a cable is installed in the busbar assembly.

With reference to FIGS. 5–9, a busbar assembly 200 according to further embodiments of the present invention is shown therein. The busbar assembly 200 includes a busbar conductor member 210, a cover member 220, four set screws 202, four caps 252, and four insert assemblies 270. FIG. 9 shows an electrical connection assembly 201 including a cable 5 connected to the busbar assembly 200.

The conductor member 210 includes conductor bores 212, front openings 214 and threaded bores 218 corresponding to elements 112, 114, 118 as discussed above, except that the conductor bores 212 do not extend all the way through the conductor member 210. However, it will be appreciated that the conductor bores 212 may be formed in the same fashion as the conductor bores 112.

The cover member 220 is a one piece design and includes four access ports 234 corresponding to the access ports 134. The cover member 220 also includes four cable ports 244 corresponding to the cable ports 144 except the cable passages 244B preferably have a slightly larger interior diameter. The caps 252 are separately formed and adapted to removably seal the access ports 234.

Each insert assembly 270 is positioned in a respective one of the cable ports 244. Each insert assembly 270 has a sleeve member 272. Each sleeve member 272 defines a passage 272A, an entrance opening 272B, and an exit opening 272C. Each sleeve member 272 has an outwardly extending flange 272D surrounding its entrance opening 272B. A closure wall 274 extends across the passage 272A of each sleeve member 272. Each insert assembly 270 includes a mass of sealant 276 disposed in the passage 272A thereof.

The sleeve members 272 may be formed of any suitable material. According to some embodiments, the sleeve members 272 are formed of a polymeric material such as polypropylene, polyethylene, or polyurethane.

According to some embodiments, the sealant 276 is a gel as described above. Each insert assembly 270 is positioned in the cable passage 244B of the associated port 244 such that the sealant 276 is positioned between the entrance opening 244C and the exit opening 244D in the passage 244B of the cable tube 244A. The insert assembly 270 is maintained in position by the flange 272D, which limits insertion depth, and a frictional fit, welding, adhesive or other suitable securement between the outer wall of the sleeve member 272 and the inner wall of the cable tube 244A. Ribs 272E extend lengthwise along and project into the passage 272A. The ribs 272E provide additional surface area for holding the sealant 276.

Preferably, sleeve member passages 272A and the masses of sealant 276 have dimensions corresponding to those discussed above with regard to the cable passages 144A and the sealant 160, respectively. According to some embodiments, the wall thickness of the sleeve member 272 is no greater than 0.125 inch.

The busbar assembly 200 may be used in the same manner as described above for the busbar assembly 100. The busbar assembly 200 may be preferred for ease of assembly, particularly where a one-piece cover member 220 is desired. The insert assemblies 270 may be separately molded or otherwise formed. The sealant 276, such as a gel, may be installed in the sleeve members 272 by curing in situ in the manner described above for the cover member 240 and the gel sealant 160. The cover member 220 may be molded about the conductor member 210 in conventional manner. The insert assemblies 270 may then be inserted into the respective cable ports 244 and suitably secured in place. The insert assemblies 270 may also be used to retrofit conventional busbar connectors.

Figure 10:
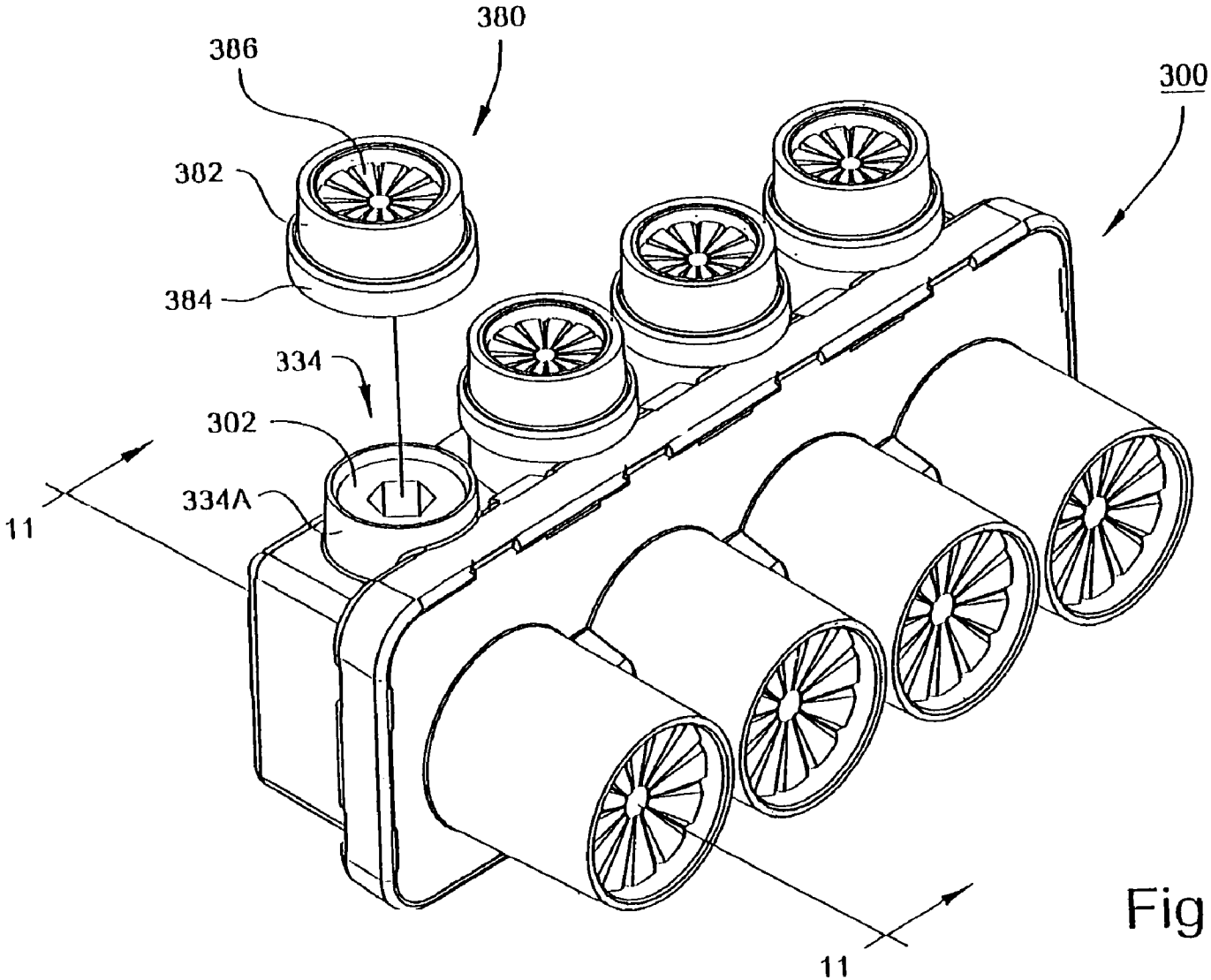
FIG. 10 is an exploded, perspective view of a busbar assembly according to further embodiments of the present invention.
Figure 11:
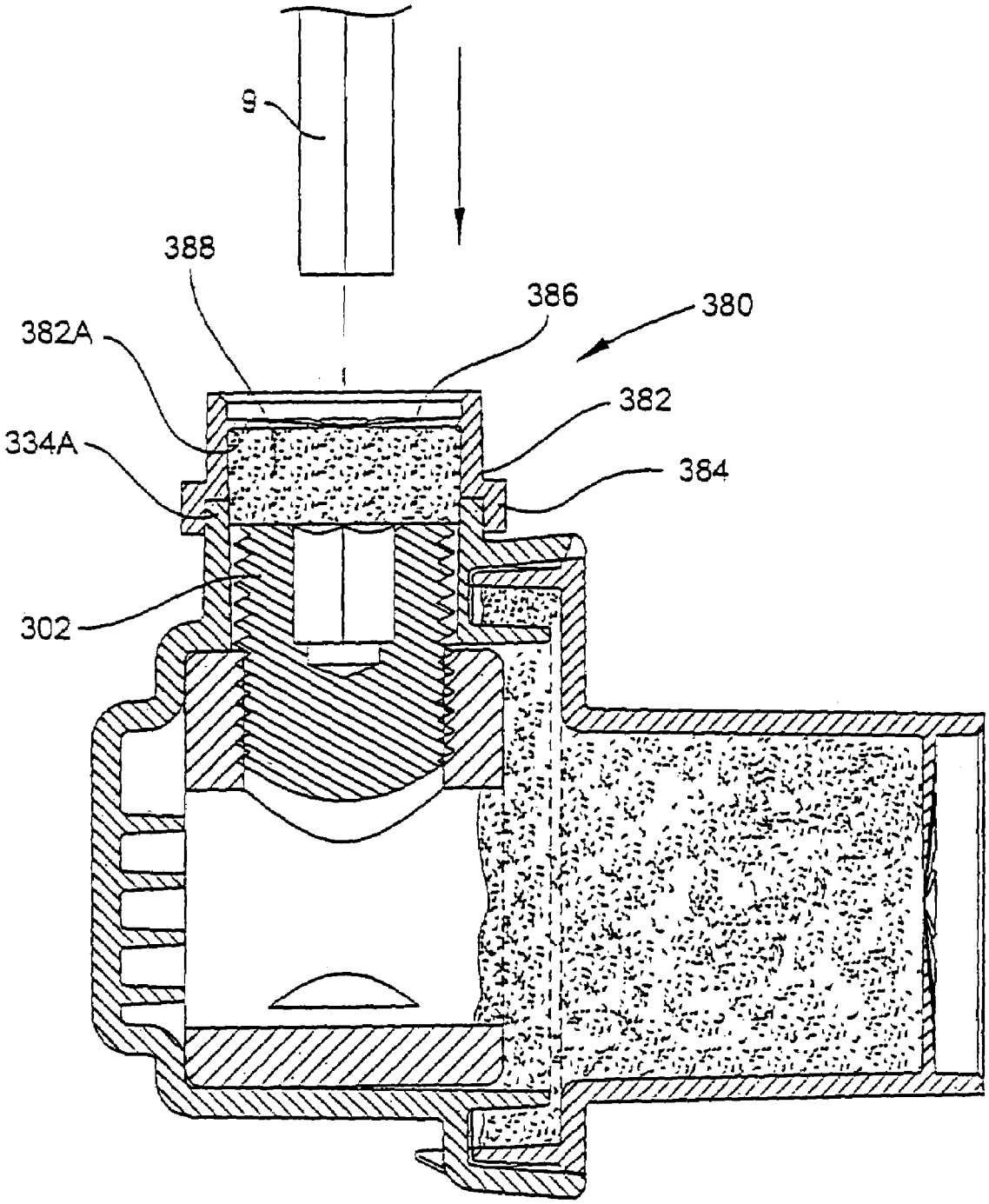
FIG. 11 is a cross-sectional view of the busbar assembly of FIG. 10 taken along the line 11—11 of FIG. 10.

With reference to FIGS. 10 and 11, a busbar assembly 300 according to further embodiments of the present invention is shown therein. The busbar assembly 300 corresponds to the busbar assembly 100, except as follows. The access tubes 334A of the access ports 334 are shortened and a cap assembly 380 is installed over each. Each cap assembly 380 includes a cap body 382 defining a passage 382A. Each cap body 382 includes a flange 384 and a closure wall 386. Each cap body 382 is secured, for example, by friction fit, welding, adhesive, snap latch and/or other suitable means, to a respective one of the access tubes 334A. A mass of sealant 388, preferably a gel as described above, is disposed in each passage 382A and in an upper portion of the associated access tube 334A. The masses of sealant 388 and the closure walls 386 serve to protect the busbar assembly 300 from the infiltration of moisture and/or contaminants.

The busbar assembly 300 may be used in the same manner as the busbar assembly 100 except that, in order to rotate each set screw 302 to secure or release a cable, the driver 9 is inserted through the closure wall 386 and the sealant 388. After the screw 302 is positioned as desired, the driver 9 is withdrawn from the sealant 388. Where, as preferred, the sealant 388 is a gel as described above, the gel 388 re-forms to again form a barrier to prevent or reduce infiltration of moisture and contaminants.

The cap bodies 382 are preferably formed of the same material as the sleeve members 272 as described above. The sealant (for example, a gel) may be installed in the same manner as the sealant 276. According to alternative embodiments, the cap bodies 382 may be integrally formed with the access tubes 334A.

Figure 12:
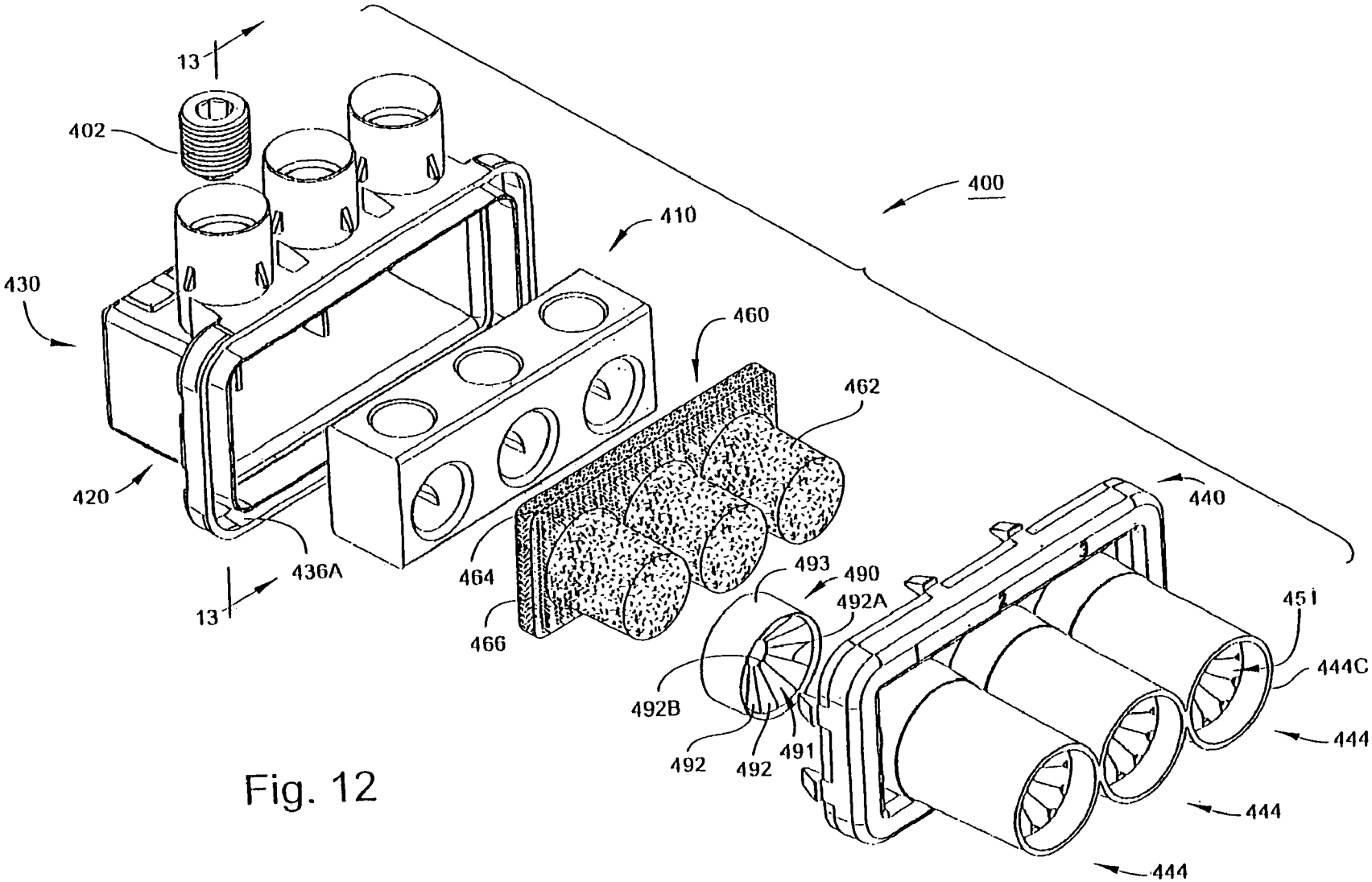
FIG. 12 is an exploded, perspective view of a busbar assembly according to further embodiments of the present invention.
Figure 13:
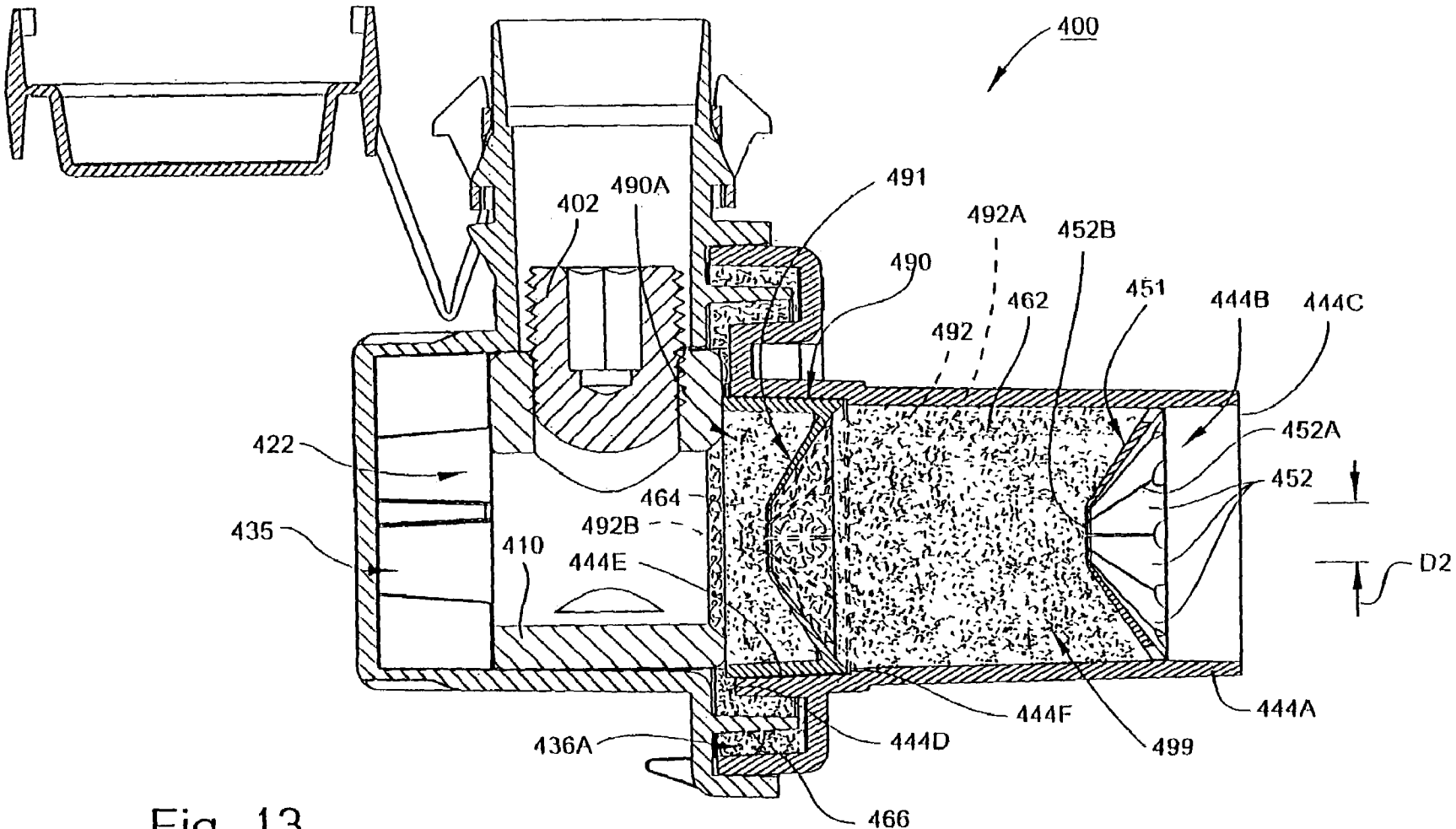
FIG. 13 is a cross-sectional view of the busbar assembly of FIG. 12 taken along the line 13—13 of FIG. 12.

With reference to FIGS. 12 and 13, a busbar assembly 400 according to further embodiments of the present invention is shown therein. The busbar assembly 400 corresponds to the busbar assembly 100, except as follows. The busbar assembly 400 includes a conductor member 410, a cover assembly 420, cover members 430, 440, and sealant 460 generally corresponding to the elements 110, 120, 130, 140 and 160 discussed above, respectively. Each port 444 includes a cable tube 444A defining a cable passage 444B. The cable passage 444B communicates with an entrance opening 444C and an exit opening 444D.

A penetrable closure wall 451 extends across the passage 444B between the openings 444C and 444D. The closure wall 451 may be integrally molded with the tube 444A. With reference to FIG. 13, the closure wall 451 includes a plurality of discrete fingers or flaps 452 separated by gaps 452A. The flaps 452 are flexible. According to some embodiments, the flaps 452 are also resilient.

According to some embodiments, the flaps 452 are concentrically arranged and taper inwardly in a direction A from the entrance opening 444C to the exit opening 444D to form a generally conical or frusto-conical shape. According to some embodiments, the angle of taper is between about 10 and 60 degrees. The closure wall 451 defines a hole 452B that may be centrally located. According to some embodiments, the inner diameter D2 of the hole 452B is less than the outer diameter of the cable or cables (e.g., the cables 5, 7) with which the assembly 400 is intended to be used. The thickness of the flaps 452 may taper in a radially inward direction. According to some embodiments, the thickness of the flaps 452 tapers in the radially inward direction at a rate of between about zero and 50 percent/inch.

An insert member 490 is positioned in the passage 444B adjacent the exit opening 444D. The insert member 490 is seated in a recess 444E in the tube 444A and positively captured between a ledge 444F and the front face of the conductor member 410. Additionally or alternatively, the insert member 490 may be otherwise secured within the passage 444B, for example, by welding, adhesive, friction fit, a mechanical latch or latches, one or more fasteners or the like.

The insert member 490 includes a tubular body defining a passage 490A. The insert member 490 further includes a penetrable closure wall 491 extending across the passage 490A. The closure wall 491 may be integrally formed with the body 493. The closure wall 491 may be constructed in the same manner as discussed above with regard to the closure wall 451, and includes a plurality of flaps 492 separated by gaps 492A and defining a hole 492B.

The closure walls 451 and 491 define a sealing chamber or region 499 therebetween (FIG. 13). A portion 462 of the sealant 460 is disposed in the sealing region 499. According to some embodiments, the sealant 462 substantially fills the sealing region 499. A further portion 464 of the sealant 460 is disposed between the closure wall 491 and the conductor member 410. A further portion 466 of the sealant 460 is disposed in the channel 436A.

The assembly 400 may be used in the same manner as the assembly 100 to provided an environmentally protected connection between conductors (e.g., of the cables 5, 7). Upon insertion of a cable through one of the ports 444, the cable penetrates and displaces the closure wall 451. The cable may elastically deflect the flaps 452 as the cable passes through the hole 452B. As the cable is further inserted, the cable passes through and displaces the sealant portion 462. The cable thereafter penetrates and displaces the closure wall 491 and passes into the interior cavity 422 of the housing 420. The cable is inserted into the conductor member 410 and secured using the set screw as described above.

The closure walls 451 and 491 may serve to retain the sealant 462 in the sealing region 499 to improve the sealing performance of the connector assembly 400. By retaining the sealant 462 in the sealing region 499, a suitable amount of compressive force can be maintained between the sealant and the surfaces to be sealed. Moreover, a sufficient amount of the sealant may be retained in the sealing passage to re-form into a sealing plug upon removal of the cable from the port 444. In the absence of the closure wall 491, there may be a tendency for the cable to displace the sealant 462 into the interior cavity 422 so that there is insufficient sealant 462 remaining in the passage 444B (and, more particularly, in the passage 499) to effectively seal about the cable or to seal upon removal of the cable. The closure wall 451 may likewise serve to retain the sealant 462 in the sealing region 499 as the cable is withdrawn from the port 444. The closure walls 451, 491 may wipe the sealant 462 from the cable as the cable is inserted therethrough. Thus, the closure walls 451, 491 may reduce the amount of sealant needed to provide the desired sealing performance, particularly in the case of multiple insertions and removals of the cable or cables.

Features directed to addressing other concerns may exacerbate the foregoing problems. For example, it may be desirable or even required that a chamber 435 be provided beyond the set screw 402 to allow an additional length of the conductor of the cable to be inserted into the conductor block 410. This additional length may serve to provide a greater margin for error in installing the cable and to improve the integrity of the securement (e.g., to reduce the risk of extruding the cable out from beneath the set screw 402). However, the chamber 435 may allow an undesirably great amount of the sealant 462 to be displaced from the passage 444B. The closure wall 491, by preventing or limiting the displacement of the sealant 462 into the chamber 435, allows for the provision of the chamber 435 without an undue loss of sealing performance.

The busbar assembly 400 may be formed in the same manner as the assembly 100 as discussed above. However, in the case of the assembly 400, the insert member 490 may be placed in the recess 444E before curing the sealant 460 (and typically before dispensing the uncured sealant into the front cover member 440). In this manner, the sealant 460 may help to secure the insert member 490 in place in the front cover member 440.

Figure 14:
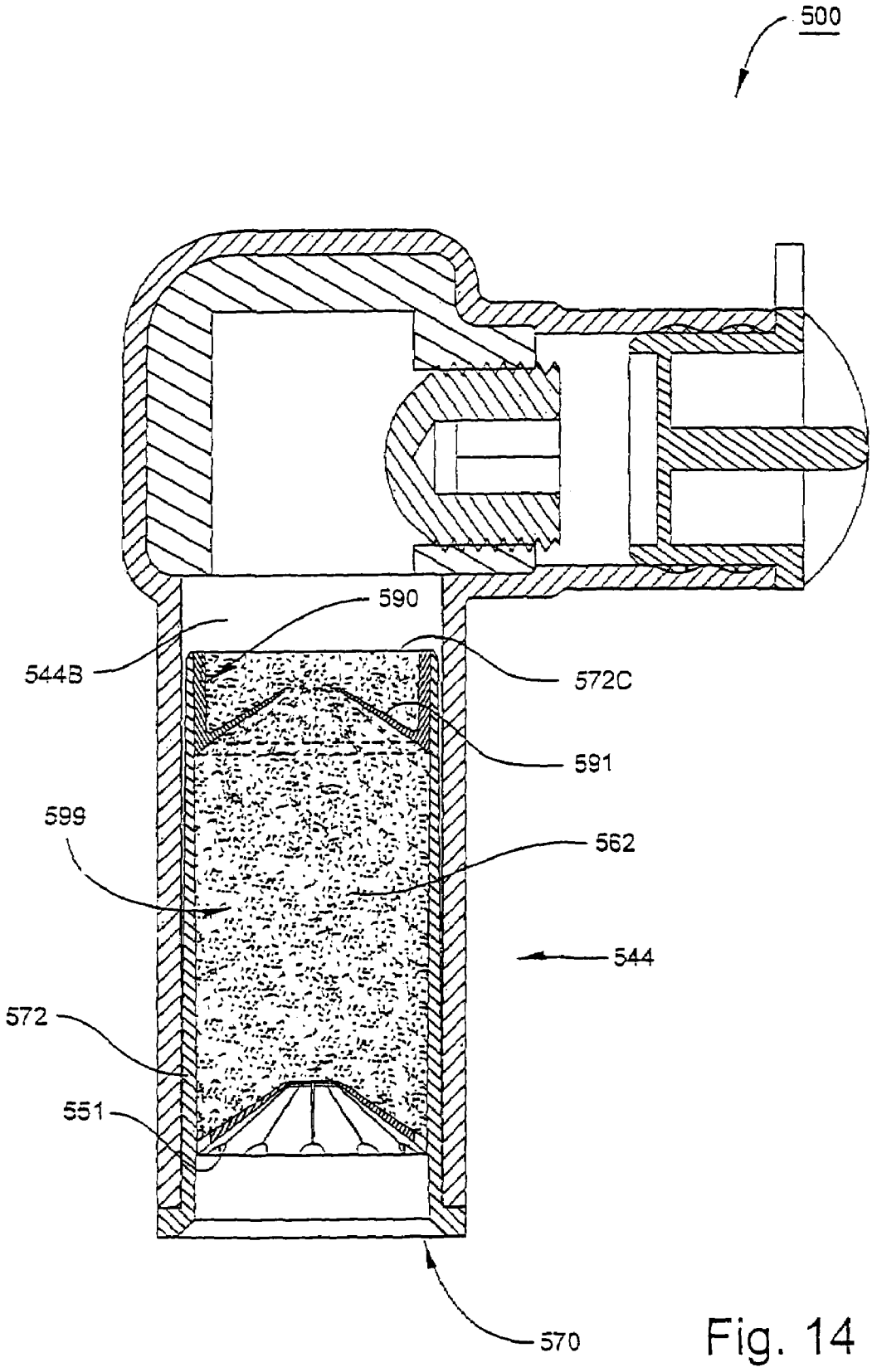
FIG. 14 is a cross-sectional view of a busbar assembly according to further embodiments of the present invention.

With reference to FIG. 14, a busbar assembly 500 according to further embodiments of the present invention is shown therein. The busbar assembly 500 corresponds to the busbar assembly 200, except as follows.

The busbar assembly 500 includes an insert assembly 570 in one or more ports 544 (one shown in FIG. 14). The insert assembly 570 corresponds to the insert member 270, except as follows. The insert assembly 570 has a penetrable closure wall 551 constructed as described above for the closure wall 451 in place of the frangible closure wall 274. The insert member 570 additionally includes an insert member 590 corresponding to the insert member 490 and secured (e.g., by holding, adhesive, friction fit, or other suitable means) in the passage 544A of the sleeve 572. The insert member 590 includes a further penetrable closure wall 591 constructed as described above for the closure wall 491. The closure walls 551 and 591 define a sealing chamber or region 599 therebetween. Sealant 562 is disposed in the sealing region 599. According to some embodiments, the sealant 562 substantially fills the sealing region 599. According to some embodiments, and as shown, the sealant 562 extends to the exit opening 572C.

The assembly 500 may be used in the same manner as the assembly 200 as described above. However, by provision of the additional closure wall 591, the assembly 500, and more particularly, the insert assembly 570, can provide the advantages discussed above with regard to the busbar assembly 400.

Where the closure walls 150, 274, 386, 451, 491, 551 and 591 are elastically resilient, they will be spring biased against the outer surface of the inserted cable when displaced by the cable. This biased engagement may serve to enhance the engagement of the closure wall against the cable to thereby retain the pressure on the sealant. The biased engagement may also serve to improve the wiping effect as the cable is inserted or withdrawn. The geometry of the closure wall may further assist in improving the seal and wiping effect.

Various modifications may be made to the foregoing busbar assemblies 100, 200, 300, 400, 500 in accordance with the present invention. For example, the body sealant portion 164 may be omitted. According to some embodiments, the closure walls 150, 274, 386 may be omitted.

The closure walls 150, 274, 386 may be otherwise constructed so as to be penetrable and displaceable. For example, the closure walls 150, 274, 386 may be constructed in the manner described above for the closure walls 451, 491, 551, 591. Similarly, the closure walls 451, 491, 551, 591 may be constructed so as to be fully or partly frangible. Closure walls of different designs and constructions may be used in the same connector as well as in the same port. For example, the outer closure wall may be frangible and formed as described for the closure wall 150 while the inner closure wall is formed as described for the closure wall 451.

Moreover, various features of the above-described closure walls may be combined. For example, one or more of the closure walls may be frangible with a pre-formed hole corresponding to the hole 452B formed therein and/or with a tapered shape. The closure walls including a plurality of flaps may be formed such that they do not form a pre-defined hole (e.g., the hole 452B). As a further alternative, each closure wall may be constructed as a resilient, elastic membrane or panel having a preformed hole therein, the closure wall being adapted to stretch about the hole to accommodate the penetrating cable without rupturing. In such case, the hole is preferably smaller in diameter than the outer diameter of the intended cable.

The insert assembly 570 may be of a one piece construction wherein the closure wall 591 is integrally molded with the sleeve 572 of the insert member 570. The closure wall 491 may be integrally molded with or otherwise secured to the tube 444A without using a separate insert member 490, for example.

The inner closure walls (e.g., closure walls 491, 591) may be used without the outer closure walls (e.g., closure walls 451, 551). More than two closure walls may be employed. For example, a third closure wall may extend across the cable passage 444B in the sealing region 499.

While three or four cable ports and conductor bores and three or four access ports, screw bores and set screws are shown in each of the busbar assemblies 100, 200, 300, 400, 500, busbar assemblies according to the present invention may include more or fewer cable ports and/or access ports and corresponding or associated components as needed to allow for the connection of more or fewer cables.

Various of the features and inventions discussed herein may be combined differently than in the embodiments illustrated. For example, the cap assemblies 380 may be used in the connector 200 as well.

While the present invention has been described herein with reference to busbar assemblies, various of the features and inventions discussed herein may be provided in other types of connectors. For example, the penetrable closure walls and insert assemblies may be employed in connectors for securing a single cable or the like.

While, in accordance with some embodiments, the sealants 160, 276, 388, 460, 562 are gels as described above, other types of sealants may be employed.

Connectors according to the present invention may be adapted for various ranges of voltage. It is particularly contemplated that multi-tap connectors of the present invention employing aspects as described above may be adapted to effectively handle voltages in the range of 120 to 1000 volts.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An electrical connector for use with a conductor, the electrical connector comprising:

a) a housing defining a port, the port including:
an entrance opening;
an exit opening; and
a conductor passage extending between and communicating with the entrance and exit openings, the conductor passage being adapted to receive the conductor therethrough;

b) sealant disposed in the conductor passage, the sealant being adapted for insertion of the conductor therethrough such that the sealant provides a seal about the inserted conductor; and c) a penetrable closure wall extending across the conductor passage;

d) wherein the closure wall tapers inwardly along a direction from the entrance opening to the exit opening prior to insertion of the cable; and e) wherein:
the housing defines an interior cavity communicating with the conductor passage;
a conductor member is positioned in the interior cavity;
the interior cavity includes a volume filled with a compressible gas to receive the sealant when the sealant is displaced by the conductor; and
the sealant is located between the entrance opening and the volume.

2. The electrical connector of claim 1 wherein the closure wall is operative to retain the sealant in the passage.

3. The electrical connector of claim 1 wherein the closure wall includes a plurality of discrete flaps.

4. The electrical connector of claim 1 wherein the closure wall has a thickness of no more than 0.25 inch.

5. The electrical connector of claim 1 wherein the closure wall is formed of a polymeric material.

6. The electrical connector of claim 1 wherein at least a portion of the sealant is disposed in the conductor passage between the closure wall and the exit opening.

7. The electrical connector of claim 1 wherein at least a portion of the sealant is disposed in the conductor passage between the closure wall and the entrance opening.

8. The electrical connector of claim 1 wherein the closure wall is integrally molded with the housing.

9. The electrical connector of claim 1 wherein:

a) the housing defines a second port and an interior cavity, the second port including:
a second entrance opening;
a second exit opening; and
a second conductor passage extending between and communicating with the second entrance opening and the second exit opening, the second conductor passage being adapted to receive a second conductor therethrough;

b) sealant is disposed in the second conductor passage, the sealant being adapted for insertion of the second conductor therethrough such that the sealant provides a seal about the inserted second conductor;

c) a second penetrable closure wall extends across the second conductor passage;

d) each of the first and second ports communicates with the interior cavity; and e) the electrical connector includes:
an electrically conductive busbar conductor member disposed in the interior cavity; and
at least one holding mechanism to selectively secure each of the conductors to the busbar conductor member for electrical contact therewith.

10. The electrical connector of claim 1 wherein the closure wall is frangible.

11. The electrical connector of claim 10 wherein the closure wall includes a membrane substantially entirely sealing the passage.

12. The electrical connector of claim 10 wherein the closure wall includes a membrane substantially entirely sealing the passage.

13. The electrical connector of claim 1 wherein the closure wall defines a hole adapted to receive the conductor.

14. The electrical connector of claim 13 wherein the hole has an inner diameter smaller than an outer diameter of the conductor.

15. The electrical connector of claim 13 wherein the hole has an inner diameter smaller than an outer diameter of the conductor.

16. The electrical connector of claim 1 including an insert member separately formed from the housing and positioned in the conductor passage, wherein the closure wall forms a part of the insert member.

17. The electrical connector of claim 16 wherein the housing includes a ledge adapted to locate the insert member in the conductor passage.

18. The electrical connector of claim 17 further including a conductor member positioned in the housing such that the insert member is cooperatively secured in the conductor passage by the conductor member and the ledge.

19. The electrical connector of claim 1 including a second penetrable closure wall extending across the conductor passage such that the first and second closure walls define a sealing region therebetween, wherein at least a portion of the sealant is disposed in the sealing region.

20. The electrical connector of claim 19 wherein at least one of the first and second closure walls is frangible.

21. The electrical connector of claim 19 wherein at least one of the first and second closure walls includes a plurality of discrete flaps.

22. The electrical connector of claim 19 wherein at least one of the first and second closure walls defines a hole adapted to receive the conductor.

23. The electrical connector of claim 19 including an insert member separately formed from the housing and positioned in the conductor passage, wherein at least one of the first and second closure walls forms a part of the insert member.

24. The electrical connector of claim 23 wherein the first closure wall is integrally formed with the housing and the second closure wall forms a part of the insert member.

25. The electrical connector of claim 24 wherein: each of the first and second closure walls forms a part of the insert member; and the insert member defines an insert passage including the sealing region.

26. The electrical connector of claim 1 wherein the sealant is a gel.

27. The electrical connector of claim 26 wherein the gel is adapted to be elongated and elastically deformed by insertion of the conductor into the conductor passage.

28. The electrical connector of claim 19 wherein the first and second closure walls are operative to retain the sealant in the sealing region.

29. The electrical connector of claim 28 wherein the sealant is a gel adapted to be elongated and elastically deformed by insertion of the conductor into the sealing region.

30. An electrical connector for use with a conductor, the electrical connector comprising:

a) a housing defining a port, the port including:
an entrance opening;
an exit opening; and
a conductor passage extending between and communicating with the entrance and exit openings, the conductor passage being adapted to receive the conductor therethrough;

b) a first penetrable closure wall extending across the conductor passage;

c) a sleeve member disposed in the conductor passage and defining a sleeve passage, the sleeve member including a second penetrable closure wall extending across the conductor passage such that the first and second closure walls define a sealing region therebetween; and d) sealant disposed in the sleeve passage, the sealant being adapted for insertion of the conductor therethrough such that the sealant provides a seal about the inserted conductor;

e) wherein at least a portion of the sealant is disposed in the sealing region; and f) wherein the sealant is a gel adapted to be elongated and elastically deformed by insertion of the conductor into the sealing region.

31. The electrical connector of claim 30 wherein the sleeve member includes a projection extending into the sleeve passage to increase surface contact between the sleeve member and the sealant in the sleeve passage.

32. The electrical connector of claim 30 wherein the first and second closure walls are formed of a polymeric material.

33. The electrical connector of claim 30 wherein the sleeve member is formed of a polymeric material.

34. The electrical connector of claim 30 wherein the sealant is a gel adapted to be elongated and elastically deformed by insertion of the conductor into the sealing region.

35. The electrical connector of claim 30 wherein the sleeve member has a wall thickness of no greater than 0.125 inch.

36. The electrical connector of claim 35 wherein the sleeve member has a wall thickness of between about 0.015 and 0.100 inch.

37. A method for providing a seal to an electrical connector, the electrical connector including a housing defining a port, the port including an entrance opening, an exit opening, and a conductor passage extending between and communicating with the entrance and exit openings, the conductor passage being adapted to receive a conductor therethrough, the electrical connector further including a first penetrable closure wall extending across the conductor passage, the method comprising:

providing an insert member including:

a sleeve member defining a sleeve passage and including a second penetrable closure wall extending across the sleeve passage; and sealant disposed in the sleeve passage, the sealant being adapted for insertion of the conductor therethrough such that the sealant provides a seal about the inserted conductor; and inserting the insert member into the conductor passage such that the first and second closure walls define a sealing region therebetween;

wherein the sealant is a gel adapted to be elongated and elastically deformed by insertion of the conductor into the sealing region.

38. The method of claim 37 including the step of securing the sleeve member in the conductor passage.

39. A busbar assembly for electrically connecting first and second conductors, the busbar assembly comprising:

a) a housing defining first and second ports and an interior cavity, each of the first and second ports communicating with the interior cavity and including:
an entrance opening;
an exit opening; and
a conductor passage extending between and communicating with the entrance and exit openings, the conductor passage being adapted to receive the conductor therethrough;

b) sealant disposed in the first and second conductor passages, the sealant being adapted for insertion of the conductor therethrough such that the sealant provides a seal about the inserted conductor; and c) a first penetrable closure wall extending across the first conductor passage;

d) a second penetrable closure wall extending across the second conductor passage;

e) an electrically conductive busbar conductor member disposed in the interior cavity; and f) at least one holding mechanism to selectively secure each of the conductors to the busbar conductor member for electrical contact therewith;

g) a third penetrable closure wall extending across the first conductor passage, the third closure wall being spaced apart from the first closure wall and positioned between the first closure wall and the exit opening of the first port such that the first and third closure walls define a first sealing region therebetween, wherein at least a portion of the sealant is disposed in the first sealing region; and h) a fourth penetrable closure wall extending across the second conductor passage, the fourth closure wall being spaced apart from the second closure wall and positioned between the second closure wall and the exit opening of the second port such that the second and fourth closure walls define a second sealing region therebetween, wherein at least a portion of the sealant is disposed in the second sealing region.

40. The busbar assembly of claim 39 wherein the sealant is a gel adapted to be elongated and elastically deformed by insertion of the conductor into the first and second conductor passages.

41. The busbar assembly of claim 39 wherein each of the first and second closure walls tapers inwardly along a direction from the entrance opening to the exit opening prior to insertion of the cable.

42. The electrical connector of claim 39 wherein the sealant is a gel adapted to be elongated and elastically deformed by insertion of the conductor into the first and second sealing regions.

43. The electrical connector of claim 39 including first and second insert members disposed in the conductor passages of the first and second ports, respectively, wherein at least one of the first and third closure walls forms a part of the first insert member and at least one of the second and fourth closure walls forms a part of the second insert member.

44. An electrical connector for use with a conductor, the electrical connector comprising:

a) a housing defining a port, the port including:

an entrance opening;

an exit opening;

a conductor passage extending between and communicating with the entrance and exit openings, the conductor passage being adapted to receive the conductor therethrough; and a ledge;

b) sealant disposed in the conductor passage, the sealant being adapted for insertion of the conductor therethrough such that the sealant provides a seal about the inserted conductor;

c) a penetrable closure wall extending across the conductor passage;

d) an insert member separately formed from the housing and positioned in the conductor passage, wherein the closure wall forms a part of the insert member and the ledge is adapted to locate the insert member in the conductor passage; and e) a conductor member positioned in the housing such that the insert member is cooperatively secured in the conductor passage by the conductor member and the ledge;

d) wherein the closure wall tapers inwardly along a direction from the entrance opening to the exit opening prior to insertion of the cable.

45. The electrical connector of claim 44 wherein the sealant is a gel adapted to be elongated and elastically deformed by insertion of the conductor into the sealing region.

46. The electrical connector of claim 44 wherein the closure wall is operative to retain the sealant in the passage.

47. The electrical connector of claim 44 wherein the closure wall is frangible.

48. The electrical connector of claim 44 wherein the closure wall includes a plurality of discrete flaps.

49. The electrical connector of claim 44 wherein the closure wall defines a hole adapted to receive the conductor.

* * * * *